United States Patent [19]

Shimada

[11] 4,211,095

[45] Jul. 8, 1980

[54] STOCK RESTRAINING EFFECT ADJUSTING MECHANISM OF A STOCK GUIDE FOR USE WITH A ROLLING MILL

[75] Inventor: Hiroaki Shimada, Sapporo, Japan

[73] Assignee: Kotobuki Sangyo Kabushiki Kaisha, Sapporo, Japan

[21] Appl. No.: 1,887

[22] Filed: Jan. 8, 1979

[51] Int. Cl.[2] ..... B21B 39/16

[52] U.S. Cl. ..... 72/250

[58] Field of Search ..... 72/250, 227; 269/242

[56] References Cited

U.S. PATENT DOCUMENTS 4,100,875 7/1978 Patterson et al. ..... 254/67

FOREIGN PATENT DOCUMENTS 841534 9/1953 Fed. Rep. of Germany ..... 72/250

1408035 6/1965 France ..... 72/250

*Primary Examiner*—Milton S. Mehr

*Attorney, Agent, or Firm*—Oldham, Oldham, Hudak & Weber

[57] ABSTRACT

In a roller type stock guide of the type including, among others, a cylindrical nut member having threaded connections of opposite hands with a pair of threaded shafts and, being arranged between the two roller holder levers, operable to turn the latter in opposite directions thereby to vary the distance between the guide rollers, a ratchet type nut driving mechanism is provided which includes a ratchet wheel formed around the cylindrical nut integrally therewith, a pair of ratchet pawls movable into and out of meshing engagement with the ratchet wheel in alternate fashion under the action of a manually operable control cam, and a notching lever handle manually operable to turn the ratchet wheel and cylindrical nut in an intermittent fashion through the intermediary of either one of the ratchet pawls as placed in mesh with the ratchet wheel.

3 Claims, 5 Drawing Figures

STOCK RESTRAINING EFFECT ADJUSTING MECHANISM OF A STOCK GUIDE FOR USE WITH A ROLLING MILL

BACKGROUND OF THE INVENTION

This invention relates generally to rolling mills serially arranged on a rolling line to roll a steel stock, such as steel wire rod, or steel bar, in a successive fashion and more particularly to stock guides usable at the entrance of such rolling mills to guide the stock into engagement with the mill rolls. Specifically, the present invention is concerned with roller type entrance guides for properly directing the stock to be rolled into the roll groove of the associated rolling mill and more particularly with means for adjusting and setting the stock restraining effect of the guide rollers.

In general, entrance roller guides includes a guide box arranged on the rolling line, a pair of roller holders pivotally supported on the guide box by means of a pair of vertically extending fulcrum pins secured to the guide box on the opposite sides of the rolling line, and right and left guide rollers mounted on the forward ends of the respective roller holders in positions close to the associated roll entrance to guide the stock into the latter. The distance between the guide rollers is adjustable by rocking the roller holders laterally in opposite directions and symmetrically with respect to the line of roll pass.

Several forms of roller holder control, used to adjust the distance between the guide rollers, are known and, among others, the device of German Pat. No. 1,048,251 is most advanced. In the roller distance adjusting mechanism, incorporated in the roller guide of the German patent, a tensing spring is arranged between the pair of roller holders to normally bias the rear end portions thereof inwardly toward each other and a cylindrical shaped nut, formed with righthand and lefthand internal screw-threads, is supported between the rear end portions of the roller holders on a horizontal axis normal to the rolling line and is held against axial movement. Also, externally threaded movable members are threadably engaged with the respective sections of the cylindrical nut which are formed with righthand and lefthand internal threads, respectively, and are held between the inwardly spring-biased roller holders in abutting engagement with respective pivot pins provided thereon in aligned relation to each other. With this arrangement, the distance between the guide rollers mounted on the respective roller holders is adjustable simply by turning the cylindrical nut about its own axis thereby to move the externally threaded members axially in opposite directions.

On the other hand, work personnel in the vicinity of the rolling mills, arranged along a rolling line, and the stock guides arranged therebetween are generally under extremely severe and dangerous work conditions including the splashing of cooling water and other rigorous operating conditions. This makes it practically impossible, during operation of the rolling line, to manually turn the cylindrical nut as required to adjust the distance between the guide rollers. Under this situation, it is highly desirable to realize a guide adjusting device which is capable of manually adjusting the distance between the guide rollers or the stock restraining effect thereof to any desired extent in a simple manner.

SUMMARY OF THE INVENTION

In order to meet the above requirement, the present invention is intended to provide an improved structure of roller guide usable in the rolling of wire rod, bar and other forms of steel material, which is capable of manually adjusting the stock restraining effect of the guide rollers easily and quickly in one operation without involving any danger to the attendent even during the ON-LINE operation of the rolling equipment.

As is well known, in the rolling of such steel material, the cross section of the material is reduced in succession until the final form of product is obtained and, at each stage, it is required that the stock being rolled be directed accurately to the center of the roll groove.

Generally, with stock guides of the type concerned, the stock is directed under the restraint of a pair of right and left guide rollers which engage the stock on its opposite sides. In this connection, rolling conditions such as rolling speed and roll load are different for different roll stands in the line and this makes it necessary at each stand to set the stock restraining effect of the guide rollers in accordance with the rolling conditions at the stage. The stock restraining effect must also be properly adjustable in accordance with any subtle change of the stock in the rolling process as well as with the reduction in stock restraining effect of the stock guide due to wear of the guide rollers without delay. Further, for high speed rolling operation, it is required that the stock restraining effect of the stock guide be set with high accuracy in order to prevent any meandering or inversion of the stock being rolled. Such guide adjusting operation, however, at all times involves a substantial danger to the attendant because of the high rolling speed.

Also, in the ON-LINE operation of rolling mills, it has been very difficult and practically infeasible to adjust the stock guide and it is keenly desired that the guide adjusting operation be readily performable even under such severe conditions without involving any danger to the attendant.

The present invention provides a stock guide mechanism for adjusting the stock restraining effect of the guide rollers which satisfies all the requirements described above.

The primary object of the present invention is to provide a stock restraining effect adjusting mechanism which functions by shifting a pair of guide rollers toward or away from each other, and to move the guide rollers in symmetrical relation to the longitudinal axis or the pass-line of the stock guide, by a manual one-touch control operation.

Another object of the present invention is to provide a stock restraining effect adjusting mechanism, which enables the most strict adjustment of the operative distance between the pair of guide rollers by a manual one-touch control operation thereto.

A further object of the present invention is to provide a stock restraining effect adjusting mechanism, including a manually operatable notching handle that is upstanding and swingable in an open space above the top of the stock guide, and having an operational relation with said adjusting mechanism to cause the shifting of the guide rollers toward or away from each other, to effectively increase or reduce the operative distance of the guide rollers by controlled directional swinging of such handle.

A still further object of the present invention is to provide a most easily and accurately controllable stock restraining effect adjusting mechanism, operable even if the rolling mills are ON-LINE operation by a one-touch manual operation of a notching or ratchet handle provided for said adjusting mechanism, and where the easiness of said adjusting operation is obtained by the location of the notching handle that which is swingably held by the adjusting mechanism which extends upwardly from the top of the guide box where the apparatus is fairly open.

The guide roller adjusting mechanism according to the present invention includes a pair of right and left roller holders pivotally supported, intermediate the ends thereof, on a pair of vertically extending fulcrum pins, which are secured to the guide box or the body structure of the stock guide on the opposite sides of the pass line. As is conventional, right and left guide rollers are supported on the forward end portions of the roller holders, which lie opposite to the roll groove. The right and left roller holders have rearward extensions which carry respective pivot studs thereon. An internally screw-threaded tube or cylindrically shaped nut is horizontally supported between the pivot studs in a state held against axial movement by means of a pair of right and left brackets fixed to the guide box. The cylindrical nut is formed on one half length thereof with righthand internal threads and on the other half length with lefthand internal threads, to threadably receive a righthand screw-threaded shaft and a lefthand screw-threaded shaft, respectively, so that the outer ends of the externally threaded shafts are held opposite to the respective pivot studs carried on the roller holders at the rear ends thereof. As the rear end portions of the roller holders are normally urged inwardly toward each other under the bias of a tension spring, the pivot studs are each held, at its abutment point, in pressure contact with the adjacent extremities of the respective threaded shafts. The two threaded shafts extend through the respective fixed brackets and are supported thereby so as to be firmly held against rotation about their common axis. With this arrangement, when the internally screw-threaded tube or cylindrical nut is turned in either direction about its own axis, the two threaded shafts are moved toward or away from each other in equal amounts, allowing the roller holder levers to rock in opposite directions about the respective fulcrum pins with the pivot studs resiliently held in pressure contact with the adjacent ends of the respective threaded shafts thereby to adjust the distance between the guide rollers and their stock restraining effect.

According to the present invention, a stock guide of the type described is provided which includes an adjusting mechanism comprising, among others, a ratchet wheel formed around the internally screw-threaded tube integrally therewith and a pair of ratchet pawls movable into and out of meshing engagement with the ratchet wheel in alternate fashion under the action of a control cam connected with a notching lever handle which extends a tolerable length upwardly from the top of the guide box where the apparatus is fairly open, and which is manually operable fore and aft in a plane including the longitudinal axis of the stock guide.

The above and other objects, features and advantages of the present invention will become apparent from the following description when taken in conjunction with the accompanying drawings, which illustrate a preferred embodiment of the present invention.

DESCRIPTION OF THE PREFERRED EMBODIMENT

Figure 1:
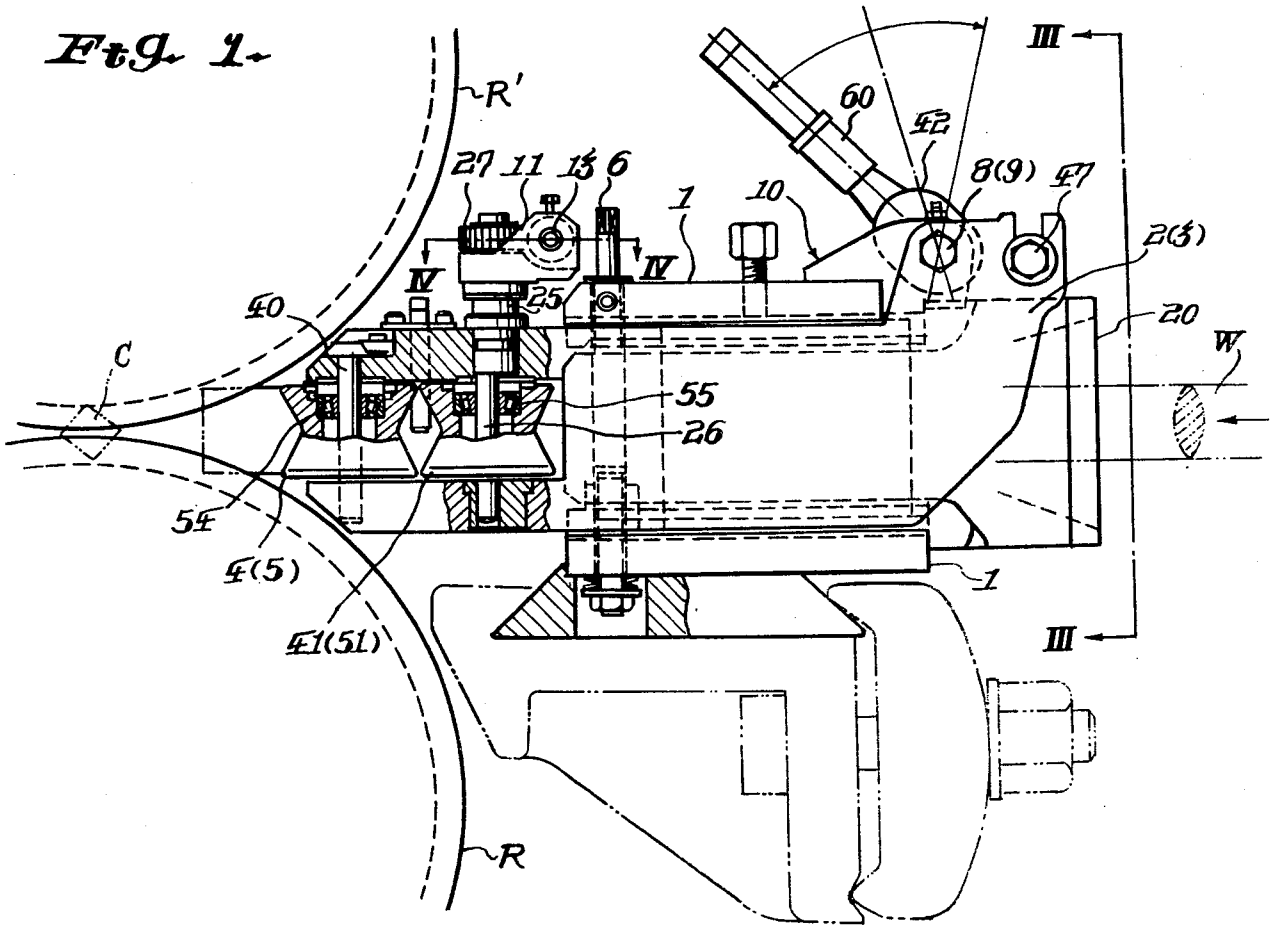
FIG. 1 is a side elevational view, partly in section, of a stock guide for rolling mill use which includes a guide roller adjusting mechanism of the present invention.
Figure 2:
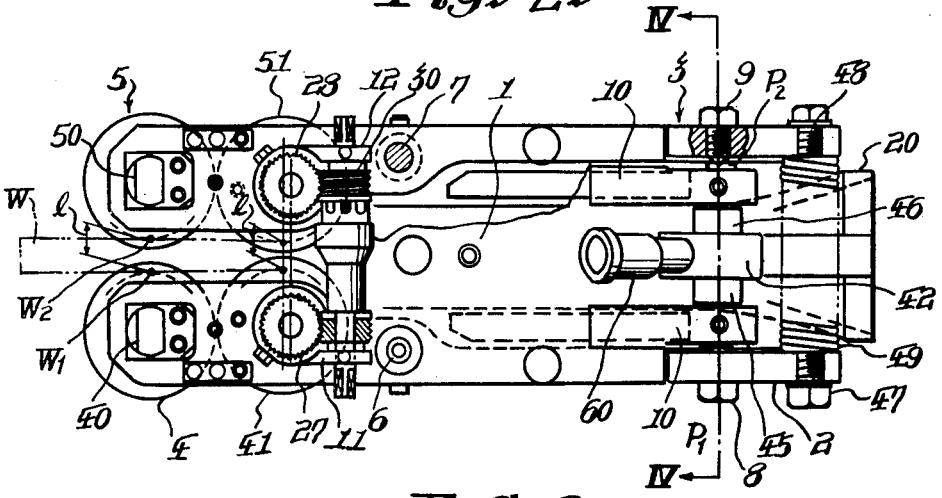
FIG. 2 is a plan view of same.

Referring to FIGS. 1 and 2, a pair of roller holders 2 and 3 are assembled into a guide body or box 1 on the right and left sides thereof symmetrically of the longitudinal axis of the guide box. A pair of main and auxiliary guide rollers 4 and 41 or 5 and 51 are rotatably mounted on each of the roller holders 2 and 3 at the forward end thereof. The roller holders 2 and 3 are themselves pivotally supported, intermediate the ends thereof, on the guide box 1 by means of respective fulcrum pins 6 and 7. An entry guide 20 is fitted to the guide box 1 along the center line thereof to serve the purpose of directing a stock W to be rolled toward the main guide rollers 4 and 5 and auxiliary guide rollers 41 and 51. The stock W is then guided to the center of the roll groove or pass C between a pair of working rolls R and R' (see also FIG. 3) principally under the restraining effect of the main guide rollers 4 and 5, and which effect is adjustable by causing the roller holders to swing in opposite directions so that the loading points $W_1$ and $W_2$ (FIG. 2) on the main guide rollers 4 and 5 are moved toward or away from each other. Specifically, the restraining force of the guide rollers, acting on the stock at the loading points $W_1$ and $W_2$, is adjustable by controllably displacing the points of pressure contact $P_1$ and $P_2$ of pivot studs 8 and 9, carried on the rear portions of the respective roller holders 2 and 3, laterally toward or away from each other thereby to cause the roller holders to swing about the axes of fulcrum pins 6 and 7, on which the roller holders are pivotally mounted.

Figure 4:
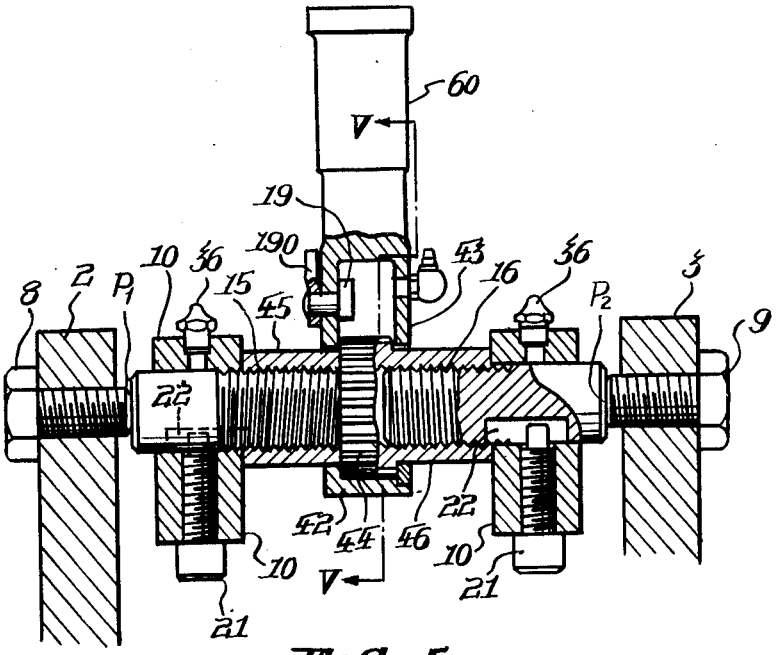
FIG. 4 is a cross section taken along the line IV—IV in FIG. 2.

As shown in FIGS. 1 and 4, a pair of right and left support brackets 10 are formed integral with the guide box 1 as upward extensions therefrom. A lefthand and a righthand screw-threaded shaft 15 and 16, which are threadedly received in respective correspondingly screw-threaded tubes 45 and 46, are fitted through the respective support brackets 10 for horizontal axial displacement relative thereto. The internally screw-threaded tubes 45 and 46 are formed integral with a ratchet wheel 44 coaxially on the respective sides thereof for rotation therewith. The threaded shafts 15 and 16 are each formed with a key groove 22 to slidably receive a key bolt 21, which is threadably mounted on the adjacent support bracket 10, and are thus held against rotation but are axially movable upon rotation of the ratchet wheel 44.

Figure 5:
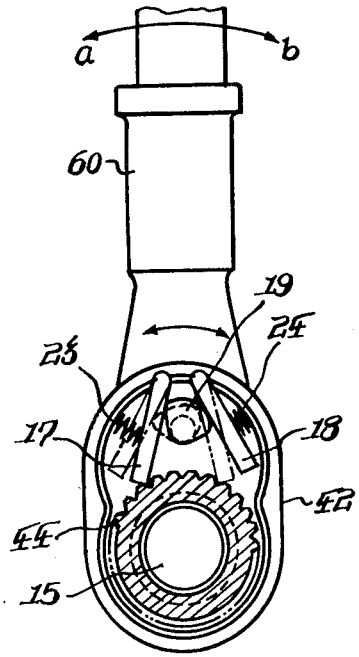
FIG. 5 is a cross section taken along the line V—V in FIG. 4.

As shown in FIG. 5, the ratchet wheel 44 is formed with ratchet teeth around the periphery thereof and is accommodated in a ratchet casing 42, which is rotatable relative to the ratchet wheel about the common axis of the ratchet wheel and the left and right screw-threaded shafts 15 and 16 in a reciprocatory fashion under the action of notching handle 60 provided therefor. A pair of ratchet pawls 17 and 18 are pivotally mounted at one end thereof on the inside of ratchet casing 42 so as to be alternately placed at the other end in and out of meshing engagement with the ratchet wheel 44. Compression springs 23 and 24 are arranged between the inner wall surface of ratchet casing 42 and the respective ratchet pawls 17 and 18 so that either one of the ratchet pawls as placed in mesh with the ratchet wheel 44 is resiliently held in place under the bias of the associated compression spring. Within the ratchet casing 42, a pawl controlling cam 19 is also provided which is rotatably supported on the adjacent wall of the ratchet casing 42 between the pair of ratchet pawls 17 in contacting relation therewith. As shown, the integral shaft of the controlling cam 19, which extends through the casing wall, is provided at its external end with a lever grip 190 (FIG. 4) which is manually operable to turn the controlling cam 19 in either direction. It will be readily noted that, as the lever grip 190 is operated to turn the controlling cam 19 from its solid line position to its dotted line position or vice versa, either one of the ratchet pawls 17 or 18, is allowed to be placed in meshing engagement with the ratchet wheel 44 under the resilience of the associated compression spring 23 or 24 while the other ratchet pawl is disengaged from the ratchet wheel 44. Under this condition, as the ratchet casing 42 is turned fore and aft by means of the notching handle 60 as indicated by the double-arrowed line a—b in FIG. 5, the ratchet wheel 44 is rotated intermittently or in step-by-step increments in that direction in which one of the meshing pawls, in this case, 17, is effective to drive the ratchet wheel.

With such rotation of the ratchet wheel 44 and hence of the internally screw-threaded tubes 45 and 46, the lefthand screw-threaded shaft 15 and righthand screw-threaded shaft 16 are driven axially to the left and right, respectively, as viewed in FIG. 4. Accordingly, the abutting points of the pivot studs 8 and 9, that is, the points of force input $P_1$ and $P_2$ to the respective roller holders 2 and 3, are incrementally moved away from each other and, in this manner, the roller holders 2 and 3 are swung in opposite directions about the respective fulcrum pins 6 and 7 against the resilience of the tension spring 49 arranged between the adjacent ends of the roller holders so that the loading points $W_1$ and $W_2$ of main guide rollers 4 and 5, carried on the forward ends of the respective roller holders, are moved toward each other and the restraining effect of the main rollers upon the stock W being rolled is increased effectively under the lever action of the roller levers or holders 2 and 3, fulcrumed at 6 and 7, respectively.

It will be readily understood that, if the control cam 19 is set in its dotted line position in FIG. 5, the same notching operation of the handle 60 results in opening movement of the main guide rollers 4 and 5 and particularly of the loading points $W_1$ and $W_2$ thereof and a corresponding descrease in their stock restraining effect. In other words, the two screw-threaded shafts 15 and 16 serve as a pair of aligned adjusting spindles movable axially in opposite directions through the respective extensions 10 of guide box 1 to precisely adjust the stock restraining effect of the stock guides.

Figure 3:
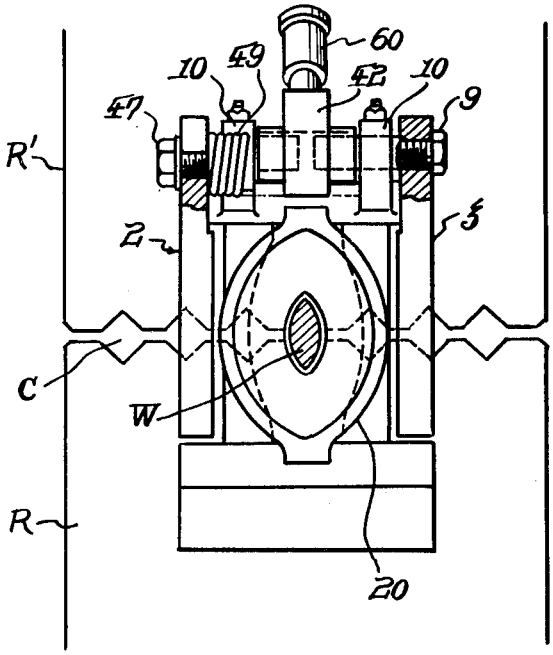
FIG. 3 is a rear elevational view, partly in section, of the stock guide, taken along the line III—III in FIG. 1.

For the reasons of aforesaid construction of the notching or ratchet handle 60, as shown in FIGS. 1, 3 and 4, the notching handle 60 extends upwardly in tolerable length from the top surface of the guide box 1, where there is no interference in operation of the notching handle, as the apparatus is fairly open in that area.

Further, it is to be noted that the roller type stock guide provided with such quick roller setting mechanism of the ratchet type of the present invention, which is extremely simple and easy to operate, should be fabricated with particular precision and completely in bilaterally symmetrical form so as to be installed exactly on the line of roll pass without any possible misalignment and thus to enable the pair of roller holders 2 and 3 to operate accurately in symmetrical fashion with respect to the longitudinal axis of the device or the line of roll pass. Moreover, a limited angular movement of the fairly extended notching handle enables the most exact adjustment of the stock restraining effect of the device. It will be apparent that, as long as the guide box 1 is arranged exactly in alignment with the center of the roll groove C, the stock W being rolled is at all times held correctly restrained on the line of roll pass and that the distance l between the peripheral surfaces of guide rollers 4 and 5 and the stock restraing effect thereof can be readily be adjusted whenever desired by a "one-touch" operation and without involving any danger to the attendant. As will readily be appreciated from the foregoing, according to the present invention, a novel stock guide has been realized which is capable of guiding the stock W with particular safety and accuracy and is manually readily adjustable as required.

Though one preferred embodiment of the present invention has been shown and described, it will be apparent to those skilled in the art that various changes and modifications may be made therein without debarting from the spirit or the scope of the invention as defined in the appended claim.

I claim:

1. In a roller type stock guide for a rolling mill which includes a guide box (1), a pair of roller holders (2, 3) pivotally mounted on the guide box by means of respective vertically extending fulcrum pins (6, 7), a pair of guide rollers (4, 5) rotatably mounted on the respective roller holders at the forward ends thereof and movable toward and away from each other with pivotal movement of the roller holders, a pair of pivot studs (8, 9) mounted on the respective roller holders adjacent to the rear ends of the latter in aligned opposite relation to each other, and spring means (49) arranged between the two roller holders to serve the purpose of normally urging the pivot studs toward each other, a mechanism for adjusting the stock restraining effect of the guide rollers which is characterized in that it comprises: an internally screw-threaded tubular member which is held against axial movement between the pair of right and left support brackets (10, 10) formed on said guide box in relation to said pivot studs (8, 9) coaxially therewith and including a first tubular section (45) internally formed with lefthand screw-threads, a second tubular section (46) internally formed with righthand screw threads, and a ratchet wheel (44) formed between said first and second tubular sections (45, 46) and being integral therewith; a pair of lefthand and righthand screw-threaded shafts (15, 16), each of them being supported against rotation but being slidable in relation to said pair of support brackets, threadably fitted in said first and second internally screw-threaded tubular sections (45, 46) and held in abutting engagement with the abutting points ($P_1$, $P_2$) of the respective pivot studs (8, 9) a pair of ratchet pawls (17, 18) pivotally movable into and out of meshing engagement with said ratchet wheel (44) in an alternate fashion, a manually operable control cam (19) for actuating said ratchet pawls alternately into and out of meshing engagement with said ratchet wheel, and a notching lever handle (60), extending in tolerable length above the top of said guide box along a plane including the longitudinal axis of said stock guide, and being manually operable to intermittently rotate said ratchet wheel (44) through the intermediary of either one of said ratchet pawls.

2. In a roller type stock guide for a rolling mill including two roller holder levers, a pair of guide rollers individually mounted on said roller holder levers, a cylindrical nut having threaded connections of opposite hands with a pair of threaded shafts and, positioned between said two roller holder levers, being operable to turn the latter in opposite directions thereby to vary the distance between the guide rollers; a ratchet type nut driving mechanism including a ratchet wheel formed around said cylindrical nut and being integral therewith, a pair of ratchet pawls movable into and out of meshing engagement with said ratchet wheel in alternate fashion under the action of a manually operable control cam, and a manually operable notching lever handle to turn the ratchet wheel and cylindrical nut in a selected direction through the intermediary of either one of said ratchet pawls as placed in mesh with the ratchet wheel to adjust the positions of said guide rollers simultaneously and equally.

3. In a roller type stock guide as in claim 2, where a guide box is provided, said roller holder levers are pivotally positioned, intermediate their ends, on said guide box and each journals a said guide roller on a corresponding end thereof, and said lever handle extends upwardly from said guide box into an open area of the apparatus.

* * * * *